US011610726B2

(12) United States Patent
Mikogami et al.

(10) Patent No.: US 11,610,726 B2
(45) Date of Patent: Mar. 21, 2023

(54) COIL DEVICE AND PULSE TRANSFORMER

(71) Applicant: TDK CORPORATION, Tokyo (JP)

(72) Inventors: Tasuku Mikogami, Tokyo (JP); Kouyu Ohi, Tsuruoka (JP); Yusuke Kimoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 628 days.

(21) Appl. No.: 16/577,344

(22) Filed: Sep. 20, 2019

(65) Prior Publication Data

US 2020/0111602 A1 Apr. 9, 2020

(30) Foreign Application Priority Data

Oct. 3, 2018 (JP) ..... JP2018-187974

(51) Int. Cl.
*H01F 27/29* (2006.01)
*H01F 27/28* (2006.01)
*H01F 27/24* (2006.01)

(52) U.S. Cl.
CPC ..... *H01F 27/2823* (2013.01); *H01F 27/24* (2013.01); *H01F 27/29* (2013.01)

(58) Field of Classification Search
CPC ..... H01F 27/2823; H01F 27/24; H01F 27/29; H01F 27/255; H01F 27/292; H01F 27/2828; H01F 27/306; H01F 17/045
See application file for complete search history.

(56) References Cited

U.S. PATENT DOCUMENTS

2004/0263285 A1* 12/2004 Suzuki ..... H01F 41/082 333/185
2017/0140858 A1* 5/2017 Takagi ..... H01F 27/292
2018/0068781 A1* 3/2018 Igarashi ..... H01F 27/2828
2018/0130593 A1 5/2018 Sukegawa et al.
2018/0330869 A1 11/2018 Kim et al.
2019/0148055 A1* 5/2019 Moriya ..... H01F 27/24 336/83

FOREIGN PATENT DOCUMENTS

CN 108369853 A 8/2018
JP 2003-188018 A 7/2003
JP 2006-80231 A 3/2006
JP 2017-228766 A 12/2017
JP 2018-078155 A 5/2018

* cited by examiner

*Primary Examiner* — Mang Tin Bik Lian
(74) *Attorney, Agent, or Firm* — Oliff PLC

(57) ABSTRACT

A coil device having high bonding strength and bonding reliability has a core member including a winding core and a flange, wires wound around the winding core and one end being positioned at the flange, and terminal electrodes provided to the flange. Each of the terminal electrodes has a wire connecting part where one ends of the wires are connected, and a mounting part continuously formed with the wire connecting part at the side close to the winding core with respect to the wire connecting part along the axis direction of the winding core. The wire connecting part is provided at a position lower than the mounting part along the height direction of the flange.

7 Claims, 7 Drawing Sheets

COIL DEVICE AND PULSE TRANSFORMER

BACKGROUND OF THE INVENTION

The present invention relates to a coil device used for example as a pulse transformer.

As a coil device used as a pulse transformer and the like, a coil device shown in Patent document 1 is known. In this conventional coil device, an end part of a wire forming a coil is connected by thermocompression to a terminal electrode having a mounting face.

However, the conventional coil device described in Patent document 1 had part of a coating film covering the wire remained on the mounting face of the terminal electrode as a residue of coating film. As a result, when the coil device is mounted on a substrate, voids and the like are formed at a connecting member such as a solder and the like which connects the mounting face of the terminal electrode and the substrate. Cracks may be formed from the voids, and in some case a connection reliability may be compromised.

Also, due to the influence from heat when the wire is connected by thermocompression, Sn layer melts and diminishes on the mounting face of the terminal electrode, as a result, adhesiveness between the terminal electrode and the connecting member such as solder and the like is deteriorated, and in some case a bonding strength may decrease.

Patent document 1: JP Patent Application Publication No. 2018-78155

BRIEF SUMMARY OF THE INVENTION

The present invention is attained in view of such circumstances, and the object is to provide a coil device and a pulse transformer having high bonding strength and bonding reliability.

In order to attain the above object, the coil device according to the present invention has a core member having a winding core and a flange, a wire wound around the winding core and one end of the wire being positioned on the flange, and a terminal electrode provided on the flange, in which the terminal electrode has a wire connecting part connecting one end of the wire with the terminal electrode, and a mounting part formed continuously with the wire connecting part at a side away from the winding core with respect to the wire connecting part along an axis direction of the wire connecting part.

In the coil device according to the present invention, the wire connecting part and the mounting part are separate parts on outer surface of the terminal electrode, thus when one end of the wire is connected by thermocompression to the wire connecting part of the terminal electrode, a residue of coating film which may be formed at the wire connecting part and adheres on the mounting part is decreased. As a result, when the coil device is mounted on the substrate, voids are less likely to be generated at the connecting member such as a solder and the like when the substrate and the mounting face of the terminal electrode are connected, thus cracks are suppressed from forming and a connection reliability is improved.

Also, since the mounting part and the connecting part are provided as separate parts at the outermost surface of the terminal electrode, the mounting part is less likely to be influenced by heat when the wire is connected by thermocompression, and Sn layer of the surface of the mounting part (the outermost surface layer which improves the adhesiveness with the connecting member such as a solder and the like) is unlikely to melt. As a result, when the coil device is mounted on the substrate, the adhesiveness between the mounting part of the terminal electrode and the connecting member such as a solder and the like is enhanced, and the bonding strength is improved.

Also, the mounting part is formed continuously with the wire connecting part and at a side away from the winding core with respect to the wire connecting part along the axis direction of the winding core, thus the wire connecting part becomes closer to the winding core, and a length of the wire from the wire connecting part to the winding core can be shortened. Thus, DC internal resistance of the coil device can be lowered (low DCR).

Further, the mounting part is formed continuously with the wire connecting part and at a side away from the winding core with respect to the wire connecting part along the axis direction of the winding core, thus the wire connecting part does not protrude out towards a width direction of the flange of the coil device (does not protrude out towards the side away from a center axis of the winding core). Therefore, the coil device can be made compact, also it becomes easy to transport and handle the coil device, and a handling property improves when the coil device is mounted.

Preferably, the wire connecting part is placed at a position lower than the mounting part along a height direction of the flange. By constituting as such, residue of coating film which may be formed at the wire connecting part and adheres on the mounting part is further decreased. Also, the mounting part is more unlikely to be influenced by heat when the wire is connected by thermocompression. Further, when the coil device is mounted on the substrate and the like, the wire connecting part is not connected to the terminal electrode but the mounting part of the terminal electrode contacts with connecting parts of the substrate, thus the connection strength of the substrate and the mounting part of the terminal electrode is improved and also the connection reliability improves.

Preferably, a step part is formed between the wire connecting part and the mounting part. By forming the step part, the wire connecting part can be easily provided at a position lower than the mounting part while providing the wire connecting part and the mounting part close to each other. Also, by having the step part, a residue of coating film which may be formed at the wire connecting part and adheres on the mounting part is further decreased.

Preferably, the outermost surface released part is formed between the wire connecting part and the mounting part. At an outermost surface of a metal member constituting the terminal electrode, a layer, for example Sn layer and the like is formed which is highly adhesive with the connecting member such as a solder and the like. Therefore, when the wire wound around the winding core is cut at an edge of the wire connecting part, due to the heat of thermocompression for connecting the wire, a portion of wire which is cut and supposed to be removed from the wire may be bonded to the terminal electrode, and in some case the wire cannot be cut appropriately.

By forming the outermost surface released part in which the outermost surface of the terminal electrode is released and removed between the wire connecting part and the mounting part, an unnecessary portion of wire is unlikely to bond with the terminal electrode when the wire is cut at the edge of the wire connecting part. As a result, the wire can be cut appropriately at the edge of the wire connecting part and the unnecessary portion of wire can be securely removed.

Also, because the outermost surface released part is formed between the wire connecting part and the mounting part, the mounting part and the wire connecting part become separate parts at the outermost surface, thus a residue of coating film which may be formed at the wire connecting part and adheres on the mounting part is further decreased. Also, the mounting part is even more unlikely to be influenced by heat when the wire is connected by thermocompression.

Preferably, the step part is formed between the wire connecting part and the mounting part, and the outermost surface released part is formed between the step part and the wire connecting part. In this case, the outermost surface released part is provided at a position lower than the mounting part along the height direction of the flange. By constituting as such, when the wire wound around the winding core is cut, the wire can be provided as a straight line on the surface of wire connecting part and outermost surface released part, thus the wire can be cut appropriately at the edge of the wire connecting part. Also, a residue of coating film which may be formed at the wire connecting part and adheres on the mounting part is further decreased. Also, the mounting part is even more unlikely to be influenced by heat when the wire is connected by thermocompression.

The flange may have a first area where the wire connecting part is provided and a second area where the mounting part is provided. A step part having a shape which corresponds to the shape of the step part formed to the terminal electrode may be formed between the first area and the second area. Alternatively, a large space which is larger than the space formed between the first area and the wire connecting part of the terminal electrode may be formed between the second area and the mounting part of the terminal electrode. Note that, the first area and the wire connecting part is preferably not adhered, and the second area and the mounting part is preferably not adhered.

Preferably, the terminal electrode further has an installation part formed continuously with the mounting part at a different position from a connecting part of the wire connecting part and the mounting part. The installation part is fixed to an outer surface of the flange by an adhesive and the like. By constituting as such, the wire connecting part and the mounting part of the terminal electrode do not need to be fixed to the flange, and a heat and impact resistance of the coil device after it has been mounted is improved.

Preferably, in the terminal electrode, an area of the wire connecting part is smaller than an area of the mounting part. By constituting as such, a heat capacity of the wire connecting part can be made small in relativity, and the influence of heat to the mounting part when the wire is connected by thermocompression can be made small.

The width of the wire connection part along the axis direction of the winding core is narrower than the width of the mounting part. By constituting as such, the area of the wire connecting part can be made smaller than the area of the mounting part.

Preferably, an exposed surface where the outer circumference face of the flange is exposed is formed between the edge of the wire connecting part at the side closer to the winding core side and the inner face of the flange at the side closer to the winding core. Further preferably, the exposed surface is chamfered. By constituting as such, an angle of the end of the wire contacting the edge of the wire connecting part at the side closer to the winding core can be enlarged, and damage to the end of the wire can be reduced.

One terminal electrode among plurality of terminal electrodes provided to the flange has a wide wire connecting part having wider width than the wire connecting part of other terminal electrodes of the flange. In the wide wire connecting part, ends of two or more wires may be connected by aligning along outer circumference direction of the flange.

The pulse transformer according to the present invention has any one of the coil device mentioned in above.

DETAILED DESCRIPTION OF THE INVENTION

Hereinafter, the present invention is described based on embodiments shown in the figures.

Figure 1:
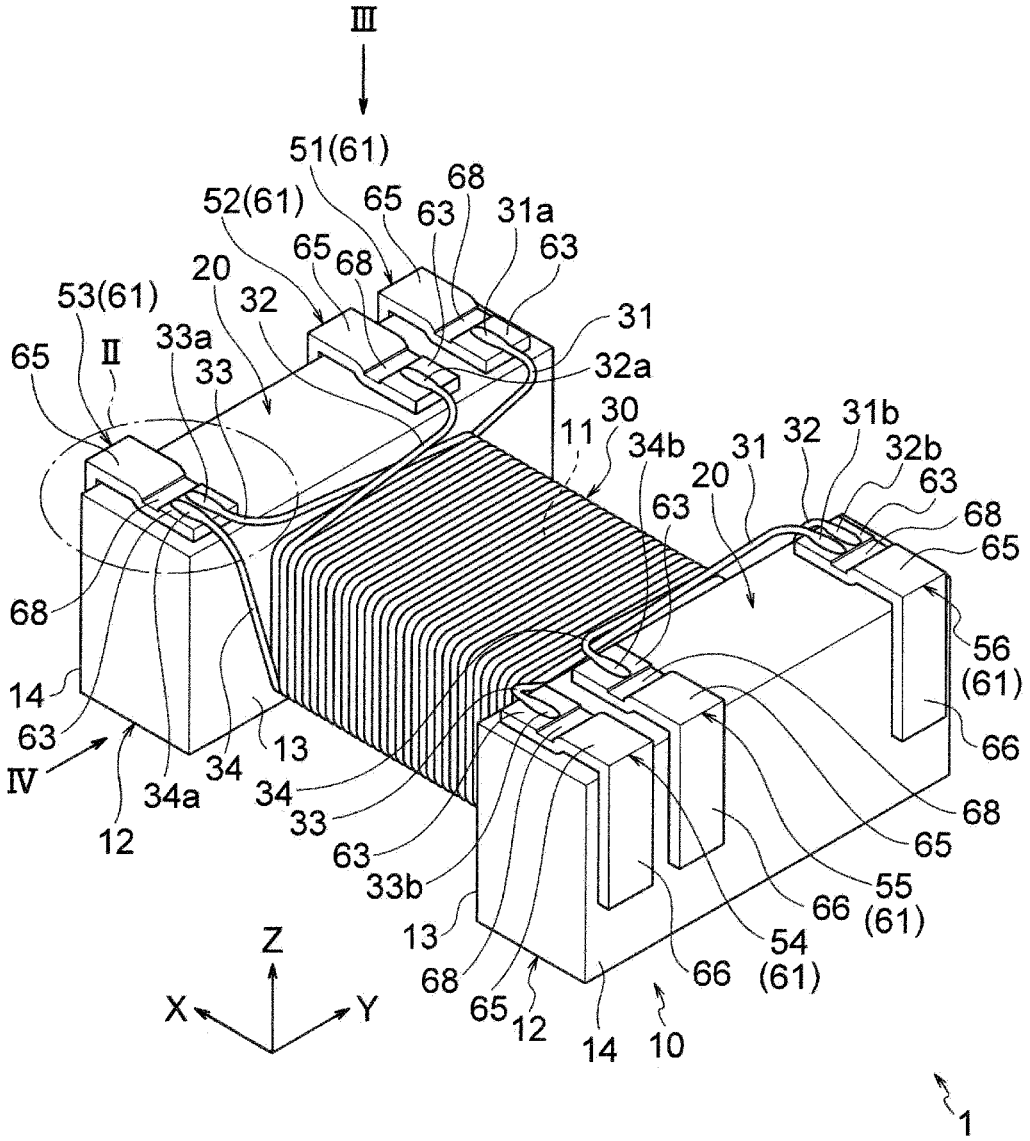
FIG. 1 is a perspective diagram of a coil device according to one embodiment of the present invention.

As shown in FIG. 1, the coil device 1 is a coil component of a surface mounting type used for example as a pulse transformer. The coil device 1 has a drum core 10 as a core member of a drum shape, a coil part 30, and terminal electrodes 51 to 56.

In the coil device 1, an upper face in Z axis direction of FIG. 1 is a mounting face when the coil device 1 is mounted on a substrate and the like. Note that, in the below description, an axis parallel to a coil axis of the coil part 30 of the coil device 1 is defined as X-axis, an axis parallel to a height direction of the coil device 1 is defined as Z-axis, and an axis approximately perpendicular to X-axis and Z-axis is defined as Y-axis.

An external dimension of the coil device 1 is not particularly limited, and for example it may be X-axis length of 3.0 to 6.0 mm, Y-axis width of 3.0 to 6.0 mm, and Z-axis height of 1.5 to 4.0 mm.

The drum core 10 has a rod shape portion (a winding core 11 shown by broken line of FIG. 3 and FIG. 4) to which the coil part 30 is wound around, and a pair of flanges 12, 12 provided to both ends of the winding core 11 in X-axis direction. A cross section shape of the winding core 11 is approximately square shape in the present embodiment, but it is not particularly limited and it may be other polygonal shape, a circular shape, or an oval shape. As shown in FIG. 1, the outer shape of the two flanges 12, 12 are both approximately rectangular parallelepiped shape, but these may have different shape and size against each other.

The drum core 10 is constituted by a magnetic member, and for example a magnetic material having a relatively high magnetic permeability such as Ni—Zn based ferrite, Mn—Zn based ferrite, or magnetic powder including metal magnetic material and the like.

Figure 3:
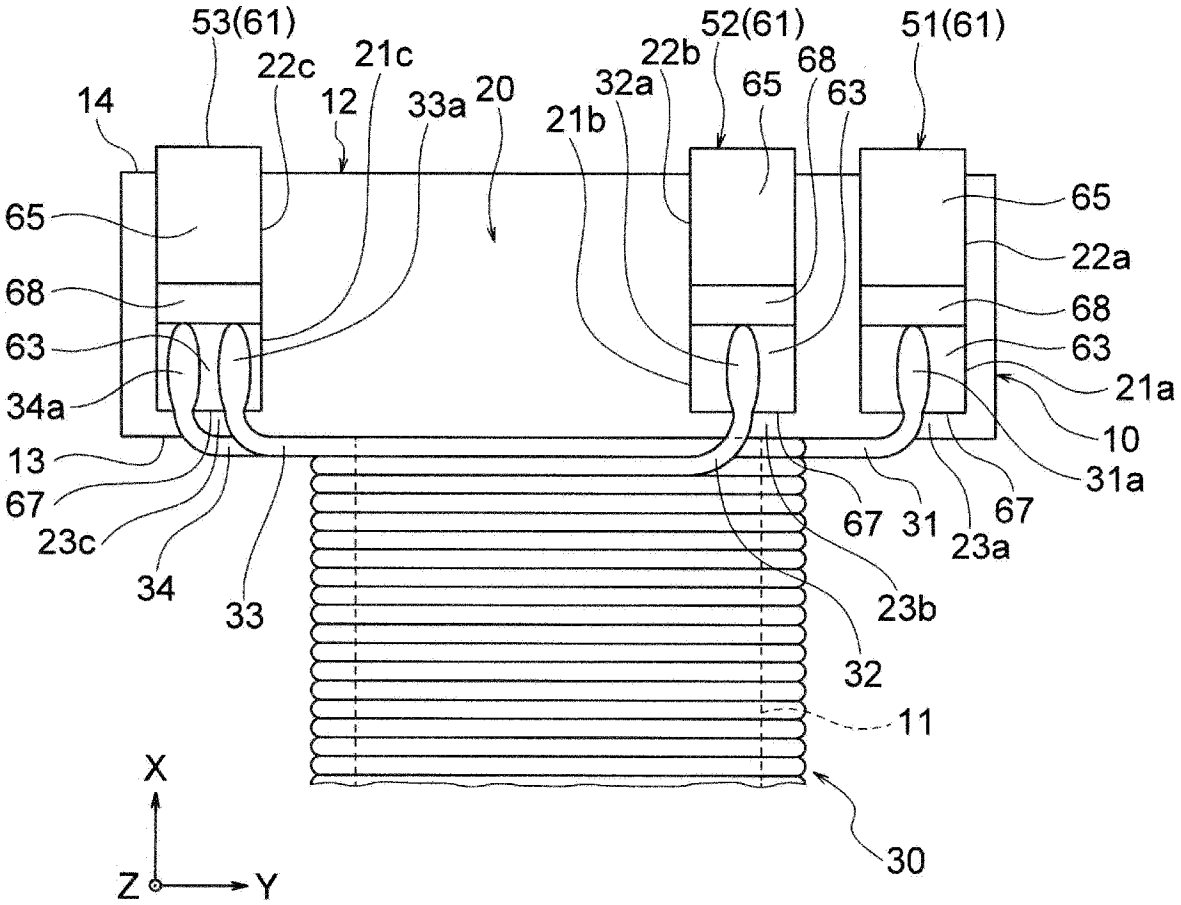
FIG. 3 is a partial planar diagram of the coil device shown in FIG. 1 and is a diagram looking from the direction of "III" indicated in FIG. 1.
Figure 4:
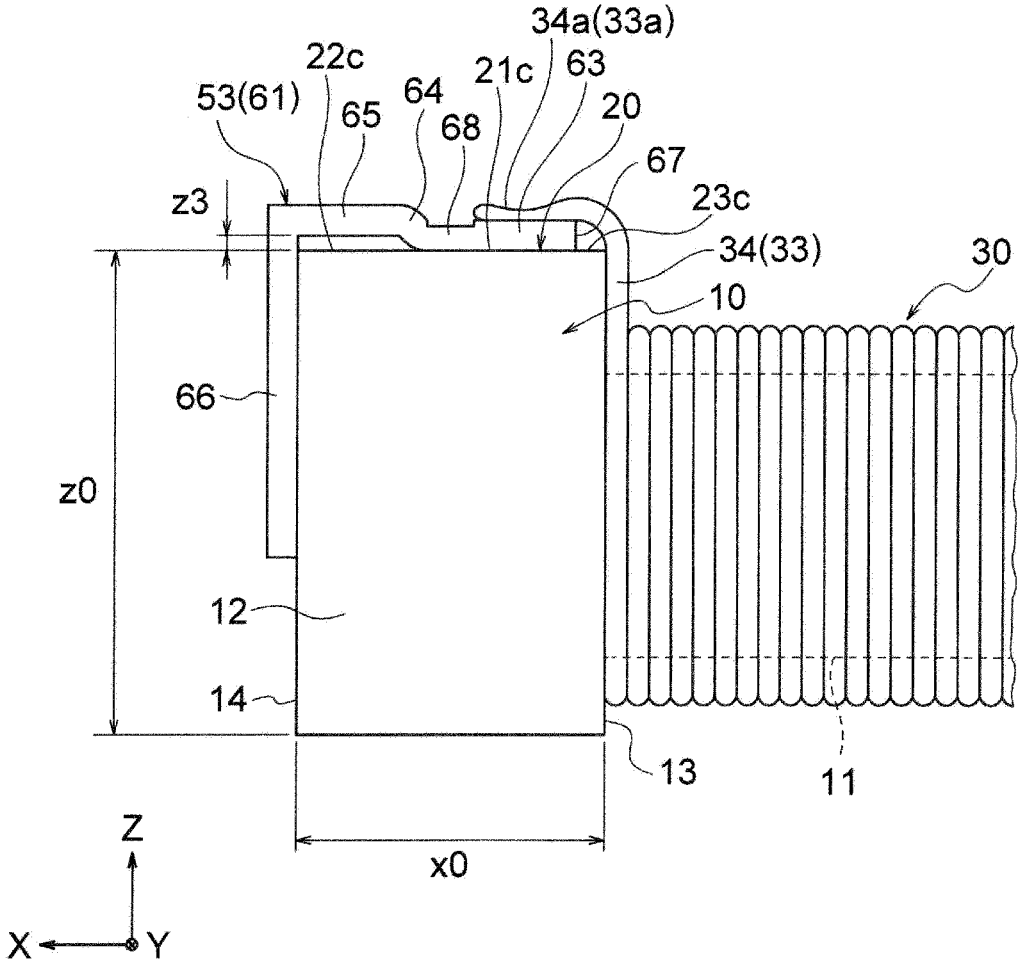
FIG. 4 is a partial side view of the coil device shown in FIG. 1 and is a diagram looking from the direction of "IV" indicated in FIG. 1.

Two flanges 12, 12 are provided so that these are approximately parallel to each other and predetermined space in X-axis direction is provided between the two flanges 12, 12. Both ends of the winding core 11 in X-axis direction are connected to a center part in Y-axis direction of an inner faces 13, 13 of opposing pair of flanges 12, 12 as shown in FIG. 3 and FIG. 4.

As shown in FIG. 1, regarding the flanges 12, 12, first to third terminal electrodes 51 to 53 are formed to the mounting face 20 of one flange 12; and fourth to sixth terminal electrodes 54 to 56 are formed to the mounting face 20 of other flange 12.

The coil part 30 is formed to the winding core 11 of the drum core 10. In the present embodiment, the coil part 30 is constituted by four wires 31 to 34 which are wound around the winding core 11. The first wire 31 and the second wire 32 constitute a primary coil as a pulse transformer, and the third wire 33 and the fourth wire 34 constitute a secondary coil. The first wire 31 and the second wire 32 forming the primary coil are wound around in opposite direction, and the third wire 33 and the fourth wire 34 forming the secondary coil are wound around in opposite direction.

Each end 31*a* to 34*a* and 31*b* to 34*b* of four wires 31 to 34 wound around in such manner are connected to the respective terminal electrodes 51 to 56 provided to the flanges 12, 12 of the drum core 10 by thermocompression.

Specifically, one end 31*a* of the first wire 31 is connected to the first terminal electrode 51, one end 32*a* of the second wire 32 is connected to the second terminal electrode 52, and ends 33*a* and 34*a* of the third wire 33 and the fourth wire 34 are both connected to the third terminal electrode 53.

Also, the other ends 31*b* and 32*b* of the first wire 31 and the second wire 32 are both connected to the sixth terminal electrode 56, and the other end 33*b* of the third wire 33 is connected to the fifth terminal electrode 55, and the other end 34*b* of the fourth terminal electrode 34 is connected to the fourth terminal electrode 54.

The wires 31 to 34 are wound around in such manner, and connected to the terminal electrodes 51 to 56. Thereby, the first terminal electrode 51 and the second terminal electrode 52 form a primary coil terminal electrode (input terminal); and the fourth terminal electrode 54 and the fifth terminal electrode 55 form the secondary coil terminal (output terminal). Also, the third terminal electrode 53 and the sixth terminal electrode 56 respectively form a center tap of the primary coil (input) and the secondary coil (output).

Each wire 31 to 34 is constituted by a coated conductive wire, and for example a core material made of a conductor having high conductivity such as copper (Cu) and the like is coated with an insulating material made of imide-modified polyurethane and the like, and the outermost surface is further coated with a thin film of resin such as polyester and the like. Note that, the core material and the coating material of the wires 31 to 34 are not limited thereto.

Also, a wire size, a number of winding, a method of winding a wire, and a number of layers of wire wound around the coil part 30 regarding each wire 31 to 34 may be determined per each wire depending on demanded properties of the coil device 1. In the present embodiment, the wire size and the number of winding of each wire 31 to 34 are same, and the wires are wound by forming a pair of wires 31 and 34 (or 32 and 34) which are wound around in the same direction, and for example four wires are wound around to form two layers.

Figure 5:
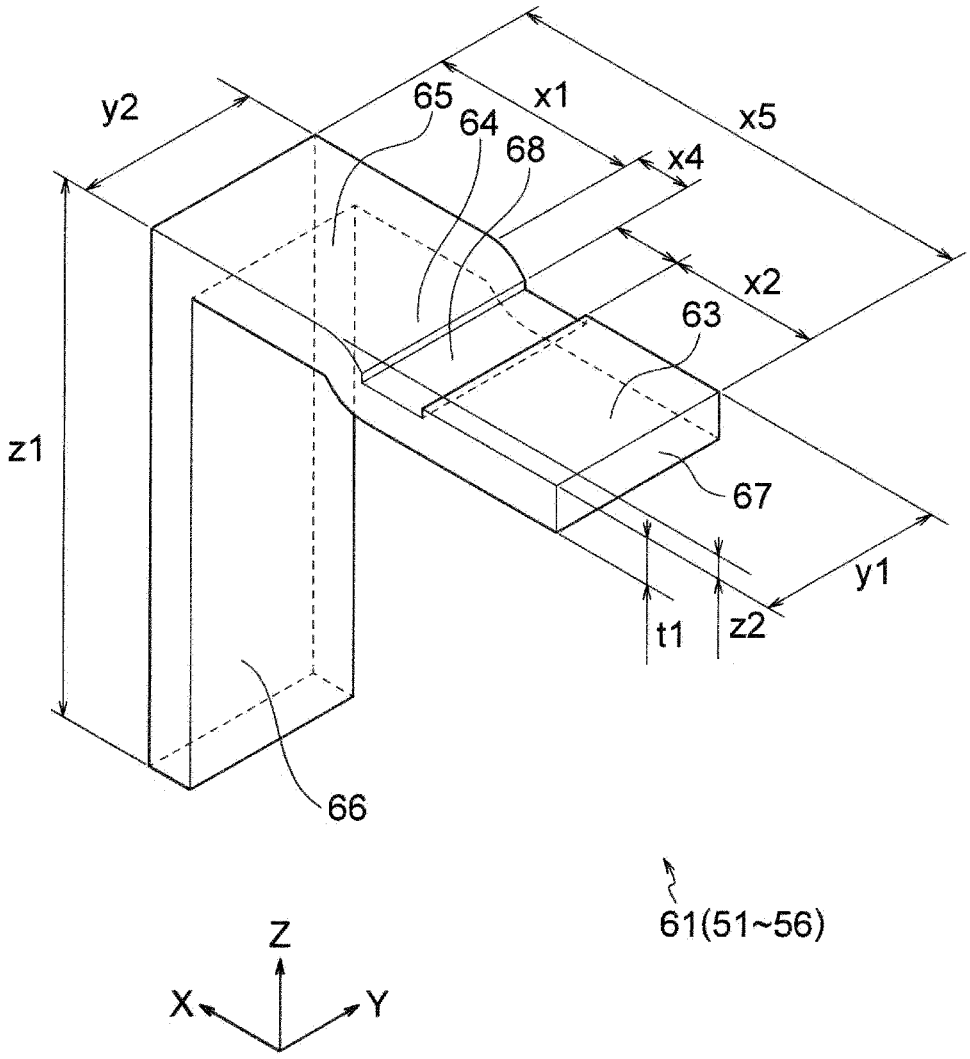
FIG. 5 is a perspective diagram showing a terminal member of the coil device shown in FIG. 1.

As shown in FIG. 5, the terminal electrodes 51 to 56 are respectively formed by bending the terminal member 61 of a metal board. The terminal member 61 is a metal for example copper, copper alloy, and the like, or it is constituted by other conductive board.

As shown in FIG. 5, in the present embodiment, each of the terminal electrodes 51 to 56 has same size and shape, and each of them has the wire connecting part 63, the mounting part 65, and the installation part 66. Note that, the wire connecting part 63 provided respectively to the terminal electrodes 53 and 56 where ends of two wires are connected may have wider width in Y-axis direction compared to the wire connecting part 63 of other terminal electrodes 51, 52, 54, and 55.

Each of the terminal electrode 51 to 56 is formed with the step part 64 between the wire connecting part 63 and the mounting part 65. The outermost surface released part 68 is formed between the step part 64 and the wire connecting part 63. The wire connecting part 63, the outermost surface released part 68, the step part 64, and the mounting part 65 are formed continuously with respective terminal electrodes 51 to 56 in X-axis direction in this order which is the order of closer ones from the winding core 11. Also, the installation part 66 is formed continuously by bending the opposite side in X-axis direction of the wire connecting part 63 from other end of the mounting part 65 in X-axis direction down along Z-axis direction.

The outermost surface released part (gap) 68 is a part where Sn layer as the outermost surface of the terminal member 61 has been released. Sn layer has a high adhesiveness with a solder, thus Sn layer is formed at the outermost surface of the metal material constituting the terminal member 61. The outermost surface released part 68 does not have Sn layer, thus the wire barely bonds with the outermost surface released part 68. By providing this outermost surface released part 68 at the position where the wire being cut and removed could possibly be in contact, the unnecessary wire being cut and removed can be prevented from bonding with the terminal member 61.

Therefore, the outermost surface released part 68 is preferably provided adjacent to the wire connecting part 63 and along an extending direction of the wire, and in the present embodiment, the outermost surface released part 68 is formed between the wire connecting part 63 and the step part 64. Note that, in the present embodiment, the outermost surface released part 68 is formed by releasing the outermost surface of the terminal member 61 by a mechanical processing, a laser processing, a solvent processing, and the like; and for example, the outermost surface released part 68 may be formed by not forming Sn layer to the area which becomes the outermost surface released part 68 of the metal material constituting the terminal member 61 from the beginning.

A height z1 in Z-axis direction of the installation part 66 is preferably shorter than or same as a height z0 in Z-axis direction of the flange 12 as shown in FIG. 4; and z1/z0 is preferably 0.2 to 1. As shown in FIG. 5, the width in Y-axis direction of the installation part 66 is preferably wider than or equal to the width y2 in axis direction of the mounting part 65, and it may be smaller. The width y1 in Y-axis direction of the wire connecting part 63 is about the same as the width y2 of the mounting part 65 in Y-axis direction, and it may be different, and preferably y1/y2 is within the range of 0.5 to 2.

Also, the width x2 in X-axis direction of the wire connecting part 63 is shorter than or equal to the width x1 in X-axis direction of the mounting part 65; and x2/x1 is preferably 1/4 to 4/4 and more preferably 1/3 to 3/4. Moreover, the area s1 (not shown in figure) of the wire connecting part 63 is preferably equal to or less than the area s2 (not shown in figure) of the mounting part 65; and s1/s2 is preferably 1/4 to 4/4 and more preferably 1/3 to 3/4.

The X-axis direction length x1 of the mounting part 65 is preferably shorter than the X-axis direction width x0 of the mounting face 20 of the flange 12 shown in FIG. 4; and x1/x0 is preferably 1/3 to 2/3. The width x3 in X-axis direction of the outermost surface released part 68 is preferably shorter than the width x2 in X-axis direction of the wire connecting part 63; and x3/x2 is preferably 1/10 to 1/2 and more preferably 2/10 to 4/10.

The wire connecting part 63 is provided at a higher position by a step height z2 in Z-axis direction than the wire connecting part 63 due to the step part 64. The outermost surface released part 68 is provided at a position lower than the wire connecting part 63 in Z-axis direction because Sn layer as the outermost surface layer is removed. Since Sn layer is a thin layer of 0.1 to 10 μm or so, the outermost surface released part 68 is provided at substantially about the same height as the wire connecting part 63.

As shown in FIG. 5, the width x4 in X-axis direction of the step part 64 is about the same height as the thickness t1 of the terminal member 61 of a metal board, and preferably the width t1 is about 1.0 times to 2 times of the thickness t1. As the step part 64 is formed between the wire connecting part 63 and the mounting part 65, the mounting part 65 is provided at a position higher than the wire connecting part 63 in Z-axis direction by a step height z2 in Z-axis direction of the step part 64. The step height z2 of the step part 64 in Z-axis direction is about the same as the thickness t1 of the terminal member 61, and preferably the step height z2 is about 1.0 times to 2.0 times of the thickness t1. The thickness t1 is not particularly limited, and preferably it is 50 to 150 μm.

A total length x5 which is the total length of the mounting part 65, the step part 64, the outermost surface released part 68, and the wire connecting part 63 in X-axis direction is determined in relation with the width x0 of the flange 12 in X-axis direction shown in FIG. 4. That is, the total length x5 shown in FIG. 5 is determined so that the exposed surfaces 23*a* to 23*c* which expose part of the mounting face 20 (part of the outer circumference face of the flange 12) are formed between the edge 67 of the wire connecting part 63 of the terminal electrode at a side closer to the winding core and the inner face of the flange 12 as shown in FIG. 3.

Figure 2:
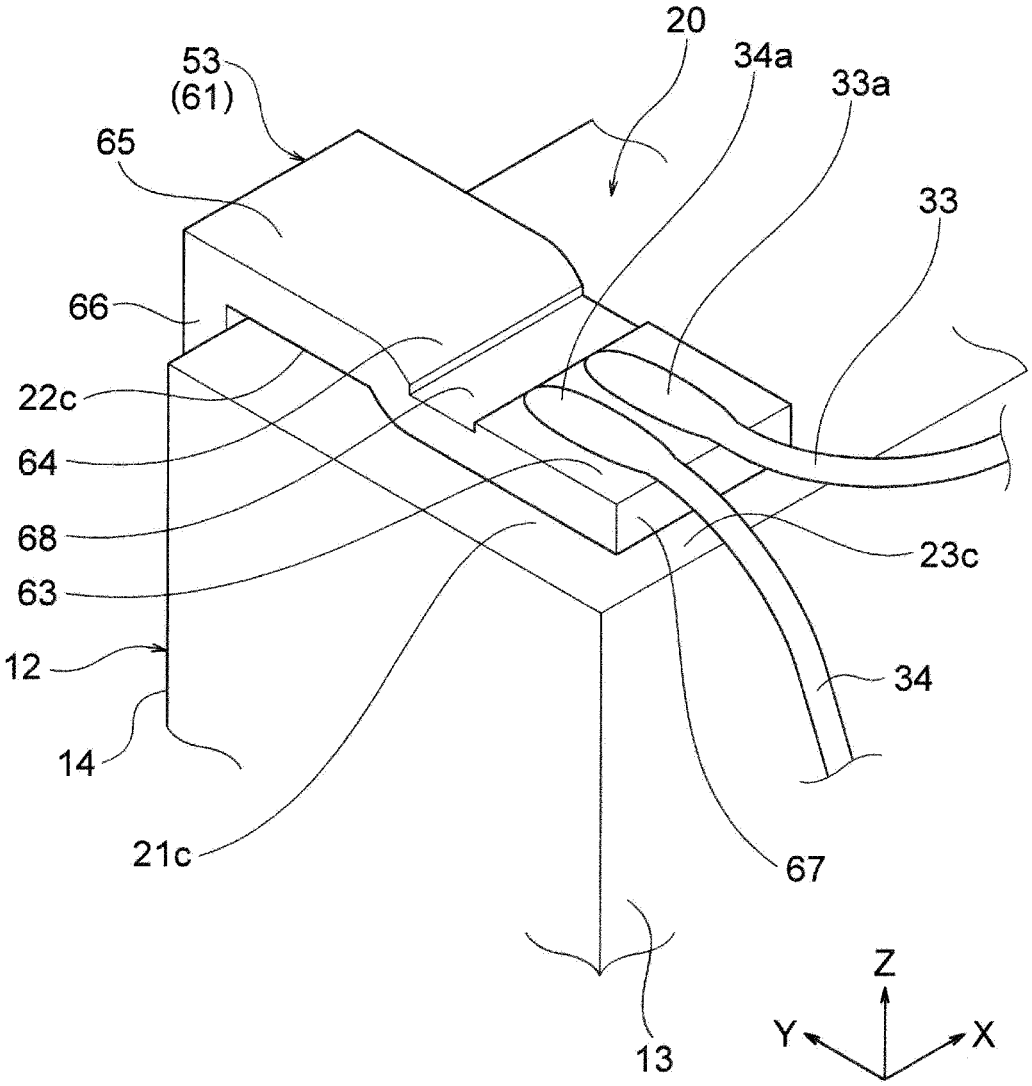
FIG. 2 is a partial perspective diagram of the coil device shown in FIG. 1 and is an enlarged diagram of a section indicated "II" in FIG. 1.

As shown in FIG. 1, the mounting face 20 of the flange 12 is a flat and smooth surface. Therefore, as shown in FIG. 2 and FIG. 4, a space is formed between the mounting part 65 of the terminal electrode 53 and the second area 22*c* of the mounting face 20 which corresponds to the mounting part 65.

As shown in FIG. 4, the wire connecting part 63 is provided by closely contacting against the first area 21*c* of the mounting face 20 of the flange 12. The end 34*a* (33*a*) of the wire 34 (33) is connected by thermocompression to the wire connecting part 63 in later step, thus the wire connecting part 63 is preferably closely contacting the mounting face 20, but it does not necessarily have to be adhered and some degree of space may be formed. A space is preferably formed between the mounting part 65 and the mounting face 20, and by having the space, the mounting part 65 can be resiliently deformed and the heat and impact resistance can be improved after the coil device 1 is mounted on the substrate and the like. Also, by having the space, coplanarity of the mounting face of the coil device 1 can be improved. Note that, the above mentioned description regarding the terminal electrode 53 using FIG. 2 and FIG. 4 can be applied to other terminal electrodes 51 to 56 shown in FIG. 1.

As shown in FIG. 1, the installation part 66 of the terminal member 61 constituting each terminal electrode 51 to 56 is bonded to the outer surface 14 of the flange 12 by means of adhesion and the like. The mounting part 65, the step part 64, the outermost surface released part 68, and the wire connecting part 63 of the terminal member 61 shown in FIG. 1 are preferably not adhered on the mounting face 20 and these are movable on the mounting face 20 which is the upper face of the flange 12 in Z-axis direction shown in FIG. 1.

The wire connecting part 63, the outermost surface released part 68, and the mounting part 68 of each terminal electrode 51 to 56 is not adhered to the mounting face 20 of the flange 12, thereby coplanarity of the mounting face of the coil device 1 can be improved. The coil device 1 can have improved resistance against strain or vibration of the substrate when the coil device 1 is mounted on the substrate and the like, thus a mounting reliability can be improved.

As shown in FIG. 3, when the terminal member 61 is installed to the flange 12, the wire connecting part 63 and the mounting part 65 are provided along the coil axis direction (X-axis direction in the present embodiment) of the winding core 11; and also the wire connecting part 63 is provided at a position closer to the winding core 11 than the mounting part 65. That is, the terminal electrodes 51 to 53 (54 to 56) which are all provided along the flange 12 have the wire connecting part 63 at a position towards inner side (towards the side closer to the winding core 11) of each mounting part 65.

When producing the coil device 1 having such constitution, first the terminal electrodes 51 to 56 are provided to the drum core 10. Each terminal electrode 51 to 56 has the wire connecting part 63, the outermost surface released part 68, the step face 64, and the mounting part 65 of the terminal member 61 corresponding to the terminal electrode are provided on the mounting face 20; and the installation part 66 is adhered to the outer face 14 of the flange 12; thereby each terminal electrode 51 to 56 is formed.

Note that, a method of forming the terminal electrodes 51 to 56 is not limited to a method of installing the terminal member 61, and the terminal electrodes 51 to 56 may be formed by a baking process, a plating process, and the like of a printed or coated conductive film. Even by such method, the terminal electrode having the wire connecting part 63, the step part 64, the mounting part 64, and the outermost surface released part 68 can be formed to the mounting face 20, and also the exposed surfaces 23*a* to 23*c* can be formed to the mounting face 20.

After the terminal electrodes 51 to 53 and 54 to 56 are respectively mounted to the flange of the drum core 10, then the drum core 10 is set to a winding machine, and the wires 31 to 34 are wound around the winding core 11 of the drum core 10 in a predetermined order.

Figure 6A:
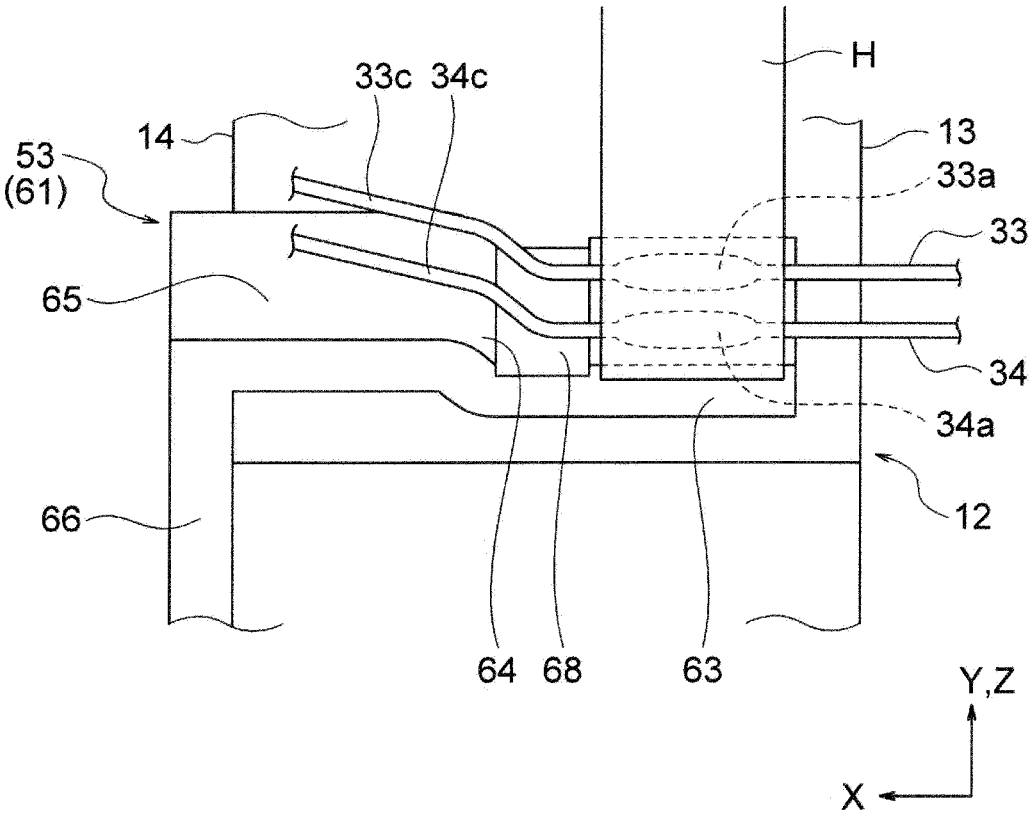
FIG. 6A is a diagram showing a wire of the coil device shown in FIG. 1 connected by thermocompression.

When the wire is wound, the ends 31*a* to 34*a* and 31*b* to 34*b* of the wires 31 to 34 are fixed by thermocompressing to the wire connecting part 63 of each terminal electrode 51 to 56. For example, in order to connect the ends 33*a* and 34*a* of the third wire 33 and the fourth wire 34 to the wire connecting part 63 of the third terminal electrode 53, as shown in FIG. 6A, while wires 33 and 34 are stretched from the winding machine not shown in the figure and placed on the wire connecting part of the third terminal electrode 53, a heater H is pressed over the wires 33 and 34 and the wire connecting part 63, then heated. Note that, a thermocompression of the wire 33 to the wire connecting part 63 and a thermocompression of the wire 34 to the wire connecting part 63 may be carried out in a separate step.

By carrying out the thermocompression, the coating material of the wires 33 and 34 is melted or removed, and the core material of wires 33 and 34 as a conductor is exposed, then by thermocompression, the wires 33 and 34 are electrically connected to the terminal electrode 53. Here, since the outermost surface released part 68 adjacent to the wire connecting art 63 is an area where Sn layer on the surface is released, it is unlikely that the wires 33 and 34 are bonded to the outermost surface released part 68 due to heat of the thermocompression. Therefore, the wires 33 and 34 are appropriately compressed only to the wire connecting part 63 of the terminal electrode 53.

In the coil device 1 of the present embodiment, the wire connecting part 63 of each terminal electrode 51 to 56 is provided closer to the coil part 30 than the mounting part 65. At the flange 12 provided with three terminal electrodes 51 to 53 or 54 to 56, the wires may be thermocompressed using one wide heater H to one flange 12, or the four wires 31 to 34 may be thermocompressed using a single heater and by changing the position of thermocompression.

Also, by using one wide heater, the ends of wires 32 and 34 which are wound in the same direction can be thermocompressed at a same time. Therefore, in the coil device 1, a step of thermocompressing the ends 31*a* to 34*a* and 31*b* to 34*b* of the wires 31 to 34 to the terminal electrodes 51 to 56 can be done easily, and also the production machine can be simplified.

Figure 6B:
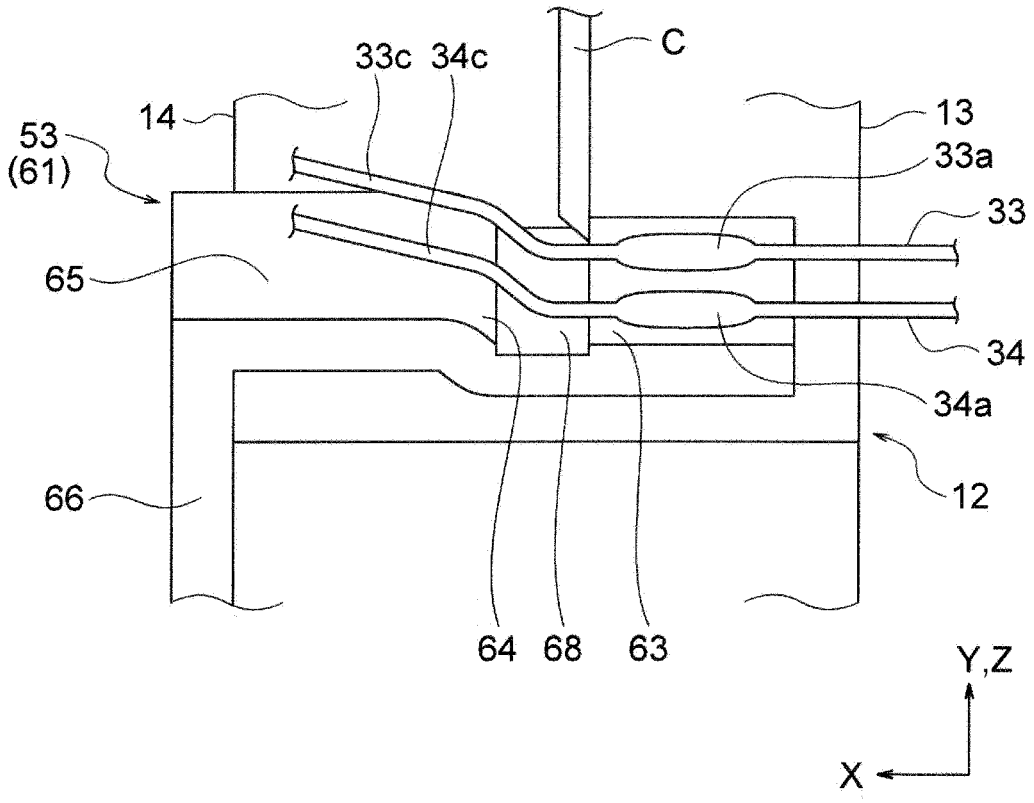
FIG. 6B is a diagram showing a wire of the coil device shown in FIG. 1 being cut.

After the ends 31*a* to 34*a* and 31*b* to 34*b* of the wires 31 to 34 are thermocompressed to the terminal electrodes 51 to 56, the ends 31*a* to 34*a* and 31*b* to 34*b* are cut off at the wire connecting portion. For example, for the third wire 33 and the fourth wire 34 thermocompressed to the wire connecting part 63 of the third terminal electrode 53, as shown in FIG. 6B, the wires 33 and 34 are cut using a wire cutter C which is lowered to the boundary between the wire connecting part 63 and the outermost surface released part 68.

When the wires are cut by a wire cutter, the ends 33*a* and 34*a* of the wires 33 and 34 positioned towards inside of the cut portion (towards the side closer to the inner face 13 of the flange 12) is kept thermocompressed to the wire connecting part 63 of the terminal electrode 53. On the other hand, the unnecessary portions 33*c* and 34*c* of the wires which are the portions towards outside from the cut portion are positioned on the outermost surface released part 68, thus these are not thermocompressed to the terminal electrode 53 and appropriately removed.

In the coil device 1 of the present embodiment, the wire connecting part 63 and the mounting part 65 are separate parts at the outermost surface of the terminal electrode, thus when one end of each wire 31 to 34 is thermocompressed to the wire connecting part 63 of respective terminal electrodes 51 to 56, a residue of coating film which may be formed at the wire connecting part 63 and adheres on the mounting part 65 is decreased. As a result, when the coil device 1 is mounted on the circuit board (not shown in figure) and the like, voids and the like in the connecting member such as a solder and the like connecting the substrate and the mounting face 63 of each of terminal electrodes 51 to 56 are decreased, thus cracks are suppressed from forming and a connection reliability improves.

Also, the wire connecting part 63 and the mounting part 65 are separate parts of the terminal electrodes 51 to 56 at the outermost surface, therefore the mounting part 65 is unlikely to be influenced by heat when the wire is connected by thermocompression, and Sn layer on the surface of the mounting part 65 (the layer improving the adhesiveness with the connecting member such as a solder and the like) is unlikely to melt. As a result, when the coil device 1 is mounted on the substrate and the like, the adhesiveness between the mounting part of each terminal electrode 51 to 56 and the connecting member such as a solder and the like is enhanced, thus the bonding strength improves.

Also, the mounting part 65 is formed continuously to the wire connecting part 63 at a side away from the winding core 11 along X-axis direction with respect to the wire connecting part 63, thus the wire connecting part 63 becomes closer to the winding core 11, and the length of the wire stretched from the wire connecting part 63 to the winding core 11 can be shortened, hence DC internal resistance of the coil device can be lowered (low DCR).

Further, the mounting part 65 is formed continuously at a side away from the winding core 11 with respect to the wire connecting part 63, thus the wire connecting part 63 does not protrude out of the flange 12 in Y-axis direction. Therefore, the coil device 1 can be made more compact, and also transport and handling of the coil device 1 becomes easier, and also the handling property can be improved when the coil device 1 is mounted.

Also, since the mounting part 65 is formed close to the wire connecting part 63 via the step part 64, even lower DCR can be attained. Further, the wire connecting part 63 is provided at a position lower than the mounting part 65 along the height direction (Z-axis direction) of the flange 12. Thus, a residue of coating film which may be formed at the wire connecting part 63 and adheres on the mounting part 65 is further decreased. Also, the mounting part 65 is even more unlikely to be influenced by heat when the wire is connected by thermocompression. Further, when the coil device 1 is mounted on the substrate and the like, it is not the wire connecting part 63 of the terminal electrode but the mounting part 65 of the terminal electrode first contacts to the connection part of the substrate, thus the connection strength between the substrate and the mounting part 65 of each terminal electrode 51 to 56 further improves and the connection reliability improves.

Also, the step part 64 is formed between the wire connecting part 63 and the mounting part 65, thus the step part 64 has a function to determine the position of the wires 31 to 34 when the wires start to wind or to determine the position of cut of the wires 31 to 34 after the winding is finished and thermocompression is done, hence the ends of the wires 31 to 34 can be cut appropriately. Also, since the step part 64 is formed, a residue of coating film which may be formed at the wire connecting part 63 and adheres on the mounting part 65 is further decreased.

Also, in each of the terminal electrodes 51 to 56, the outermost surface released part 68 of which Sn layer at the outermost surface of the terminal member 61 is released is formed between the wire connecting part 63 and the mounting part 65. Thus, when the ends of the wires 31 to 34 are thermocompressed and cut at the wire connecting part 63, the unnecessary portions of wires (for example, 33*c* and 34*c* shown in FIG. 6B) being cut and removed are unlikely to bond with the terminal electrodes 51 to 56 which may be caused by heat when the wire is thermocompressed. As a result, the wires 31 to 34 are cut appropriately and the unnecessary portions can be removed.

Also, by forming the outermost surface released part 68 between the wire connecting part 63 and the mounting part 65, the mounting part 65 is separated from the wire connecting part 63 at the outermost surface, hence a residue of coating film which may be formed at the wire connecting part 63 and adheres on the mounting part 65 is further decreased. Also, the mounting part is even less influenced by heat of connecting the wire by thermocompression.

Also, the outermost surface released part 68 is provided at a position lower than the mounting part 65 along the height direction (Z-axis direction) of the flange 12, hence when the wires 31 to 34 wound around the winding core are cut, the wires 31 to 34 can be provided in a straight line at the surface of the wire connecting part 63 and the outermost surface released part 68, the wires 31 to 34 can be cut appropriately at end of the wire connecting part 63. Also, a residue of coating film which may be formed at the wire connecting part and adheres on the mounting part 65 is even more decreased. Also, the mounting part is even less influenced from heat when the wire is connected by thermocompression.

Furthermore, in the present embodiment, the exposed surfaces 23*a* to 23*c* exposing the outer circumference face of the flange 12 are formed between the edge 67 of the wire connecting part 63 at a side closer to the winding core and the inner face 13 of the flange 12. The exposed surfaces 23*a* to 23*c* are chamfered. By constituting as such, the ends of the wires 31 to 34 can contact in a larger angle with the edge 67 of the wire connecting part 63 at a side closer to the winding core 11 (see for example FIG. 2), thereby damages to the lead ends (leads) of the wires 31 to 34 can be reduced.

Note that, the present invention is not limited to the above mentioned embodiments, and various modifications can be done within the scope of the present invention.

For example, in the above mentioned embodiment, the mounting faces 20 is constituted by a flat and smooth face, however for the first areas 21*a* to 21*c* where the wire connecting part 63 is respectively provided and the second areas 22*a* to 22*c* where the mounting part 65 is respectively provided, the second areas 22*a* to 22*c* having higher height than the first areas 21*a* to 21*c* may be formed to the mounting face 20. The core step parts are formed between the first areas 21*a* to 21*c* and the second areas 22*a* to 22*c*, and the second areas 22*a* to 22*c* are provided at higher position in Z-axis than the first areas 21*a* to 21*c*. The height of the core step parts are about the same as the step height z2 of the step part 64 shown in FIG. 5, or it may be even smaller.

In such constitution, the wire connecting part 63 shown in FIG. 5 is provided by closely contacting the first area 21*c* (21*a* to 21*c*), and the mounting part 65 shown in FIG. 5, the mounting part 65 shown in FIG. 5 is provided by closely contacting the second area 22*c* (22*a* to 22*c*). Also, the step part 64 shown in FIG. 5 is provided on the core step part.

Note that, even in this constitution, the wire connecting part 63 does not necessarily have to be adhered on the first area 21*c* (21*a* to 21*c*), and some degree of space may exist. Also, the mounting part 65 does not necessarily have to be adhered on the second area 22*c* (22*a* to 22*c*), and some degree of space may exist.

Preferably, the space between the mounting part 65 and the second area 22*c* is wider than the space between the wire connecting part 63 and the first area 21*c* shown in FIG. 4. The ends of the wires 33 and 34 are thermocompressed to the wire connecting part 63 in a subsequent step, thus the wire connecting part 63 and the first area 21*c* are preferably in close contact, but it is not a problem if a space exist between the mounting part 65 and the second area 22*c*. By having a space, the mounting part 65 can be deformed more resiliently, thus the heat and impact resistance and the like can be improved after the coil device 1 is mounted on the substrate and the like.

Further, in the above mentioned embodiment, a board shaped core which magnetically connect a pair of flanges 12, 12 is not provided to an opposite face of the mounting face 20 of the pair of flanges 12, 12; however a board shaped core may be bonded by adhesion and the like.

Also, in the above mentioned embodiment, the third terminal electrode 53 and the sixth terminal electrode 56 are formed as a center tap for input and output respectively, but the center tap may be omitted depending on use. In such case, the third terminal electrode 53 and the sixth terminal electrode 56 are not needed and the coil device (pulse transformer) can be constituted by two wires.

Also, in the above mentioned embodiment, the present invention is described as preferable device as a pulse transformer which is used to transfer pulse signal via LAN cable and the like, but the use of the present invention is not limited thereto. For example, the present invention can be used as other coil device such as common mode filter and the like, and also the present invention can be used as any type of electronic component which connects leads of wire to the terminal electrode by thermocompression or method other than thermocompression.

NUMERICAL REFERENCES

1 . . . Coil device
10 . . . Drum core (Core member)
11 . . . Winding core
12 . . . Flange
13 . . . Inner face
14 . . . Outer face
20 . . . Mounting face
21*a* to 21*c* . . . First area
22*a* to 22*c* . . . Second area
23*a* to 23*c* . . . Exposed surface
30 . . . Coil member
31 to 34 . . . Wire
31*a* to 34*a*, 31*b* to 34*b* . . . End (lead)
51 to 56 . . . Terminal electrode
61 . . . Terminal member
63 . . . Wire connecting part
64 . . . Step part
65 . . . Mounting part
66 . . . Installation part
67 . . . Edge of wire connecting part
68 . . . Outermost surface released part

What is claimed is:

1. A coil device comprising:

a core member having a winding core and a flange;

a wire wound around the winding core with one end of the wire being positioned on the flange; and a terminal electrode provided on the flange, the terminal electrode comprising:

a wire connecting part connecting the one end of the wire with the terminal electrode;

a mounting part formed continuously with the wire connecting part at a side away from the winding core with respect to the wire connecting part along an axis direction of the wire connecting part;

an outermost surface layer of the terminal electrode; and a gap in the outermost surface layer between the wire connecting part and the mounting part, wherein the mounting part, the gap, and the connecting part are arranged, in this order, in an axis direction of the winding core.

2. The coil device according to claim 1, wherein the wire connecting part is lower than the mounting part in a height direction of the flange.

3. The coil device according to claim 2, further comprising a step part between the wire connecting part and the mounting part.

4. The coil device according to claim 2, further comprising a step part between the wire connecting part and the mounting part and the gap is between the step part and the wire connecting part.

5. The coil device according to claim 1, wherein the flange comprises a first area where the wire connecting part is located and a second area where the mounting part is located.

6. The coil device according to claim 1, further comprising an exposed surface exposing an outer circumference face of the flange between an edge of the wire connecting part at a side closer to the winding core and an inner face of the flange.

7. A pulse transformer comprising the coil device according to claim 1.

* * * * *